US010470615B2

(12) United States Patent
Chen et al.

(10) Patent No.: US 10,470,615 B2
(45) Date of Patent: Nov. 12, 2019

(54) SUPPORT DEVICE FOR STOPPER OF BATHROOM SINK OR TUB

(71) Applicant: Chih-Wei Chen, Changhua (TW)

(72) Inventors: Chih-Wei Chen, Changhua (TW); Kuang-Ming Kuo, New Taipei (TW)

(73) Assignee: Chih-Wei Chen, Changhua (TW)

( * ) Notice: Subject to any disclaimer, the term of this patent is extended or adjusted under 35 U.S.C. 154(b) by 0 days.

(21) Appl. No.: 15/982,226

(22) Filed: May 17, 2018

(65) Prior Publication Data

US 2019/0216267 A1 Jul. 18, 2019

(30) Foreign Application Priority Data

Jan. 17, 2018 (TW) ..... 107200777 U

(51) Int. Cl.
*A47K 1/14* (2006.01)
*E03C 1/23* (2006.01)

(52) U.S. Cl.
CPC ..... *A47K 1/14* (2013.01); *E03C 1/2306* (2013.01); *E03C 2201/60* (2013.01)

(58) Field of Classification Search
CPC ..... A47K 1/14; E03C 1/2306
USPC ..... 4/286–295
See application file for complete search history.

(56) References Cited

U.S. PATENT DOCUMENTS 6,138,290 A * 10/2000 Lin ..... A47K 1/14 4/286
2004/0226085 A1* 11/2004 Wang ..... A47K 1/14 4/295
2011/0138527 A1* 6/2011 Siena ..... A47K 1/14 4/295

* cited by examiner

*Primary Examiner* — Christine J Skubinna
(74) *Attorney, Agent, or Firm* — Rosenberg, Klein & Lee

(57) ABSTRACT

A stopper of a bathroom sink or tub includes a shank removably connected to a base part which is connected to the sink or tub and has a drain hole. A cap is connected to the shank and has a flange that extends radially from the cap. A connection portion is formed on the underside of the flange. A seal part is connected to the connection portion and includes a support ring and a collar. The support ring has at least one hook member formed in the inner periphery thereof so as to be connected to the connection portion of the cap. A positioning portion extends from radially from the support ring. The collar is a rubber collar and has a groove in the inner periphery thereof. The positioning portion of the support ring is engaged with the groove to prevent the collar from deformation and generating noise.

6 Claims, 4 Drawing Sheets

SUPPORT DEVICE FOR STOPPER OF BATHROOM SINK OR TUB

BACKGROUND OF THE INVENTION

1. Fields of the invention

The present invention relates to a stopper, and more particularly, to a support device of the stopper of a bathroom sink or tub, and the stopper is operated silently.

2. Descriptions of Related Art

The conventional stopper of a bathroom sink or a tub is disclosed in FIG. 4 and includes a cap 50, a seal plate 52 connected to the cap 50, a shank 60 to which the cap 50 is connected, and a base part 70 which is secured to the drain hole of the sink or the tub. The base part 70 includes a room 71 and the drain hole 711 is defined in the inner bottom of the base part 70. The shank 60 includes a threaded end 61 which is threadedly connected to the threaded hole 72 in the base part 70. The top end of the shank 60 is connected to the underside of the cap 50. The seal plate 52 is a rubber plate and connected to the bottom of the cap 50.

When the user operates the cap 50 to move the seal plate 52 along the shank 60, the cap 50 together with the seal plate move downward and the seal plate 52 is attached to the top of the base part 70 to seal the room 71 and the drain hole 711. The sink or tub can be used to store water. When the cap 50 together with the seal plate 52 are moved upward to form a gap between the base part 70 and the seal plate 523, water in the sink or tub drains from the gap via the drain hole 701.

However, when the gap is formed between the base part 70 and the seal plate 523, because the seal plate 52 is a rubber plate and the cap 50 is connected to the central hole 521 of the seal plate 52. The contact area is restricted around the central portion of the seal plate 52, so that the seal plate 52 is flexible due to the nature of rubber. The outer periphery 522 of the seal plate 52 is deformed downward and is located between the top of the base part 70 and the cap 50. When pulling the cap 50 to form the gap to drain the water, the air in the sink or tub may cause the outer periphery 522 of the seal plate 52 shake and noise may be generated which is annoying to the users.

The present invention intends to provide a device of the stopper of a bathroom sink or tub, and no noise is generated.

SUMMARY OF THE INVENTION

The present invention relates to a stopper of a bathroom sink or tub, and comprises a base part having a cylindrical room defined therein and the base part has a drain hole defined through the bottom thereof. The base part is connected to a sink or a tub. A shank is removably connected to the base part and partially located in the room. A cap has a flange extending radially therefrom, and a tubular portion extends from the underside of the cap. The top end of the shank is connected to the tubular portion. A connection portion is formed on the underside of the flange. A seal part is connected to the connection portion and has a support ring and a collar. The support ring has at least one hook member formed in the inner periphery thereof. The at least one hook member is connected to the connection portion of the cap. A positioning portion extends radially from the outer periphery of the support ring. A distance is formed between the underside of the positioning portion and the underside of the support ring. The collar is a flexible collar, and a groove is defined in the inner periphery of the collar. The positioning portion of the support ring is engaged with the groove of the collar. The support ring supports the collar to prevent the collar from deformation and generating noise.

The advantages of the present invention are that the seal part is connected to the underside of the cap. The seal part includes a support ring and a collar. The support ring includes multiple hook members which hook the underside of the cap. The support ring includes a positioning portion formed on the outer periphery thereof, and the positioning portion is engaged with the groove in the inner periphery of the collar. The seal part is a ring-shaped part, and the support ring supports the collar which is not deformed downward such that when the cap is pulled upward to drain the water in the sink or the tub, the collar is not deformed and does not shake to generate noise.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
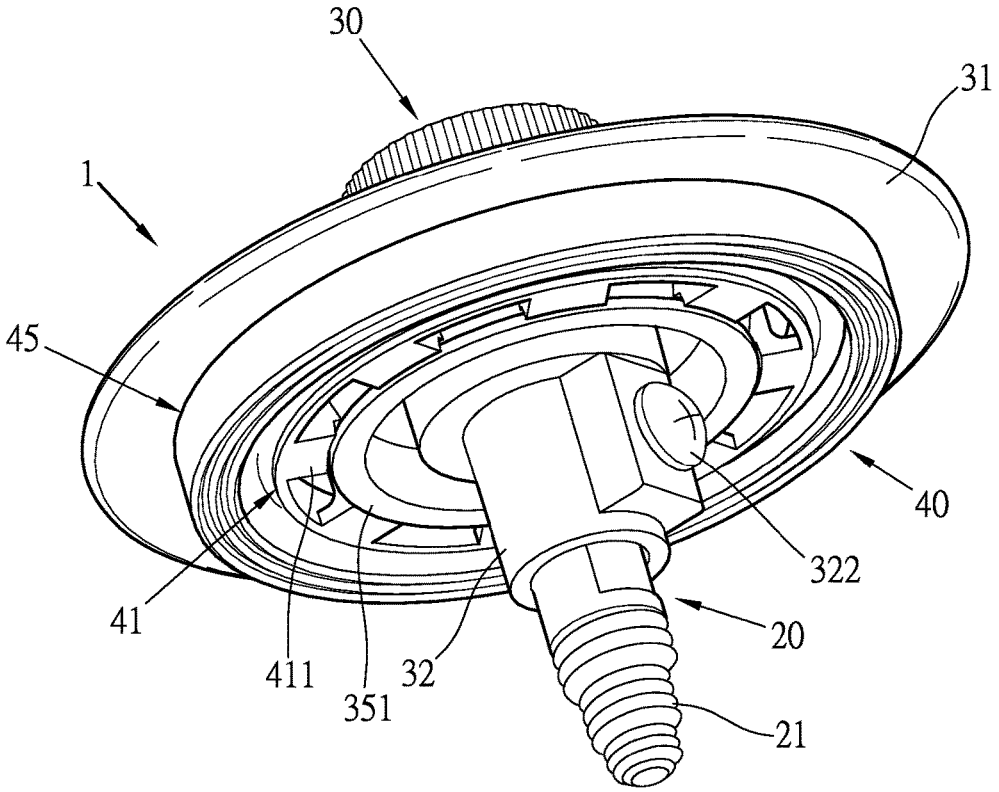
FIG. 1 is a perspective view to show the stopper of the present invention.
Figure 2:
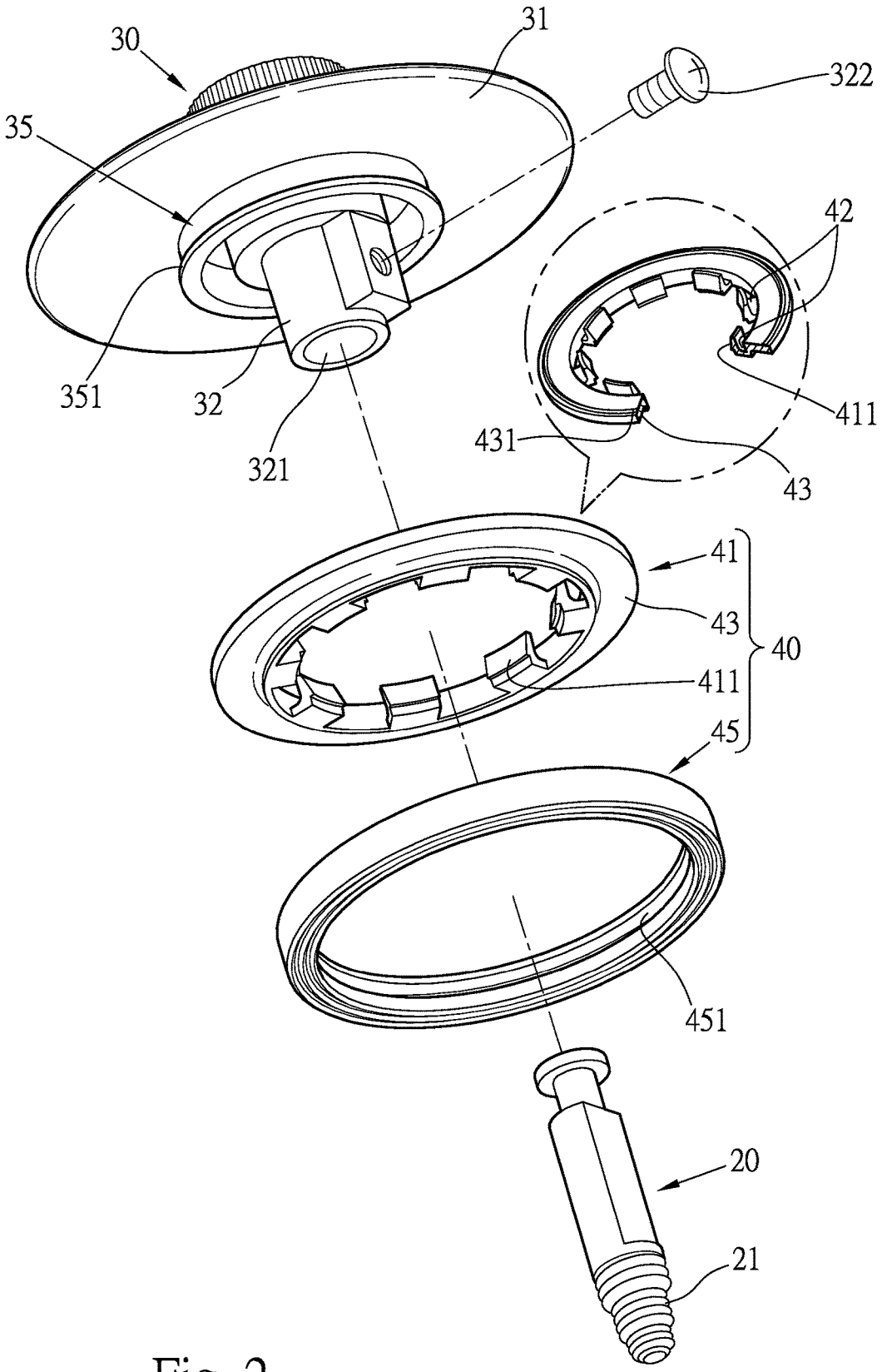
FIG. 2 is an exploded view of the stopper of the present invention.

Referring to FIGS. 1 and 2, the stopper 1 of the present invention comprises a base part 10 that is connected to a sink or a tub, and the base part 10 has a cylindrical room 11 defined therein. The base part 10 has an open top and multiple drain holes 12 defined through the bottom thereof. The drain holes 12 communicate with the drain pipe. A shank 20 includes a threaded end 21 at the lower end thereof and the threaded end 21 is threadedly and removably connected to the threaded hole 13 of the base part 10. The shank 20 is partially located in the room 11. A cap 30 is connected to the top end of the shank 20 and a seal part 40 is connected to the underside of the cap 30. When the cap 30 and the seal part 40 are moved upward and downward, the seal part 40 opens and seal the base part 10.

The cap 30 has a flange 31 extending radially therefrom, and a tubular portion 32 extends from the underside of the cap 30. The tubular portion 32 of the cap 30 has a recess 321 defined in the lower end thereof. The top end of the shank 20 is inserted into the recess 321, and a bolt 322 radially extends through the tubular portion 32 and slightly contacts a flat surface of the shank 32. A ring-shaped connection portion 35 is formed on the underside of the flange 31, and the tubular portion 32 is located within the connection portion 35. The connection portion 35 of the cap 30 has an L-shaped cross section. The vertical portion of the L-shaped cross section of the connection portion 35 is a lip 351 which extends radially outward from the connection portion 35.

Figure 3:
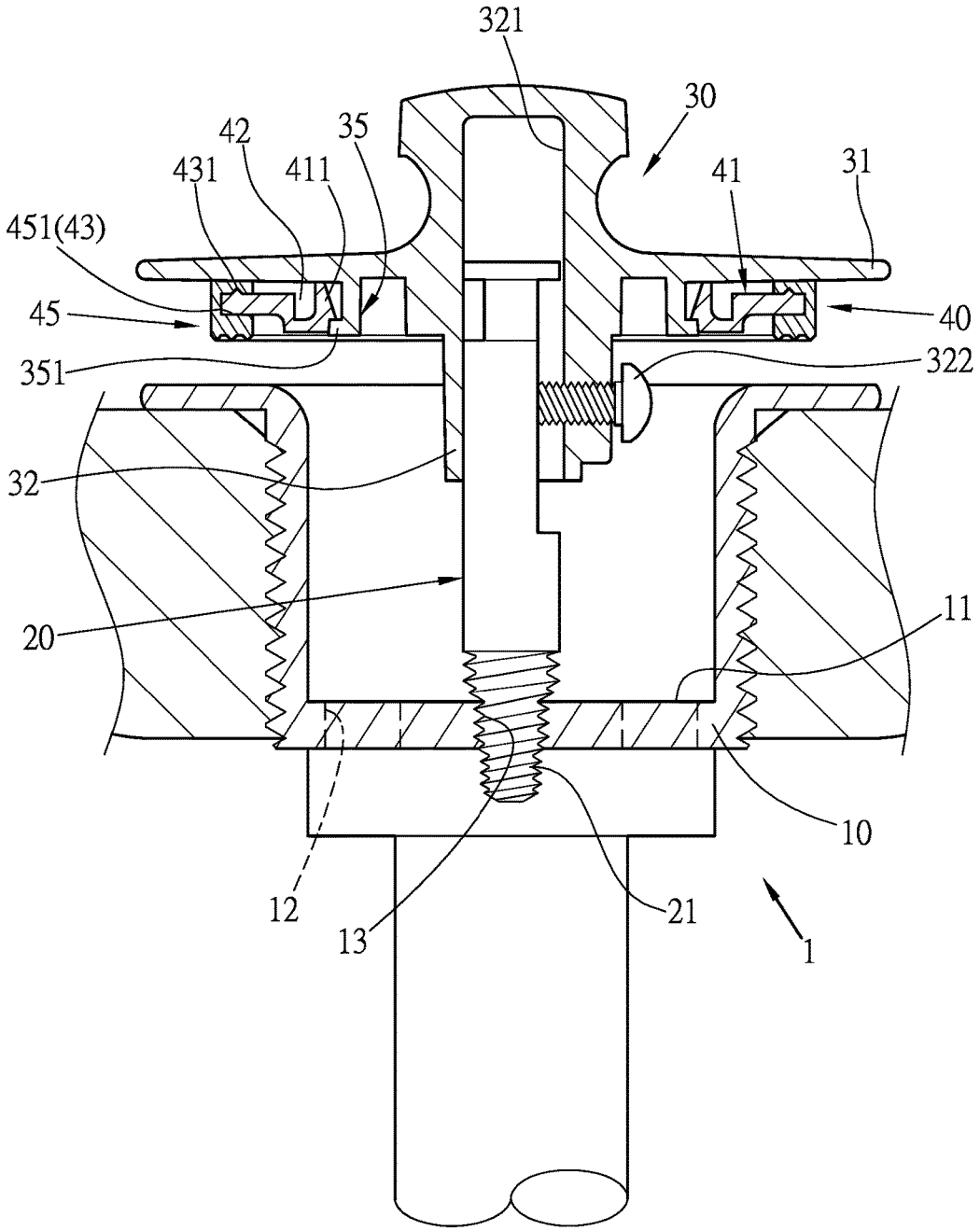
FIG. 3 is a cross sectional view to show the stopper of the present invention.
Figure 4:
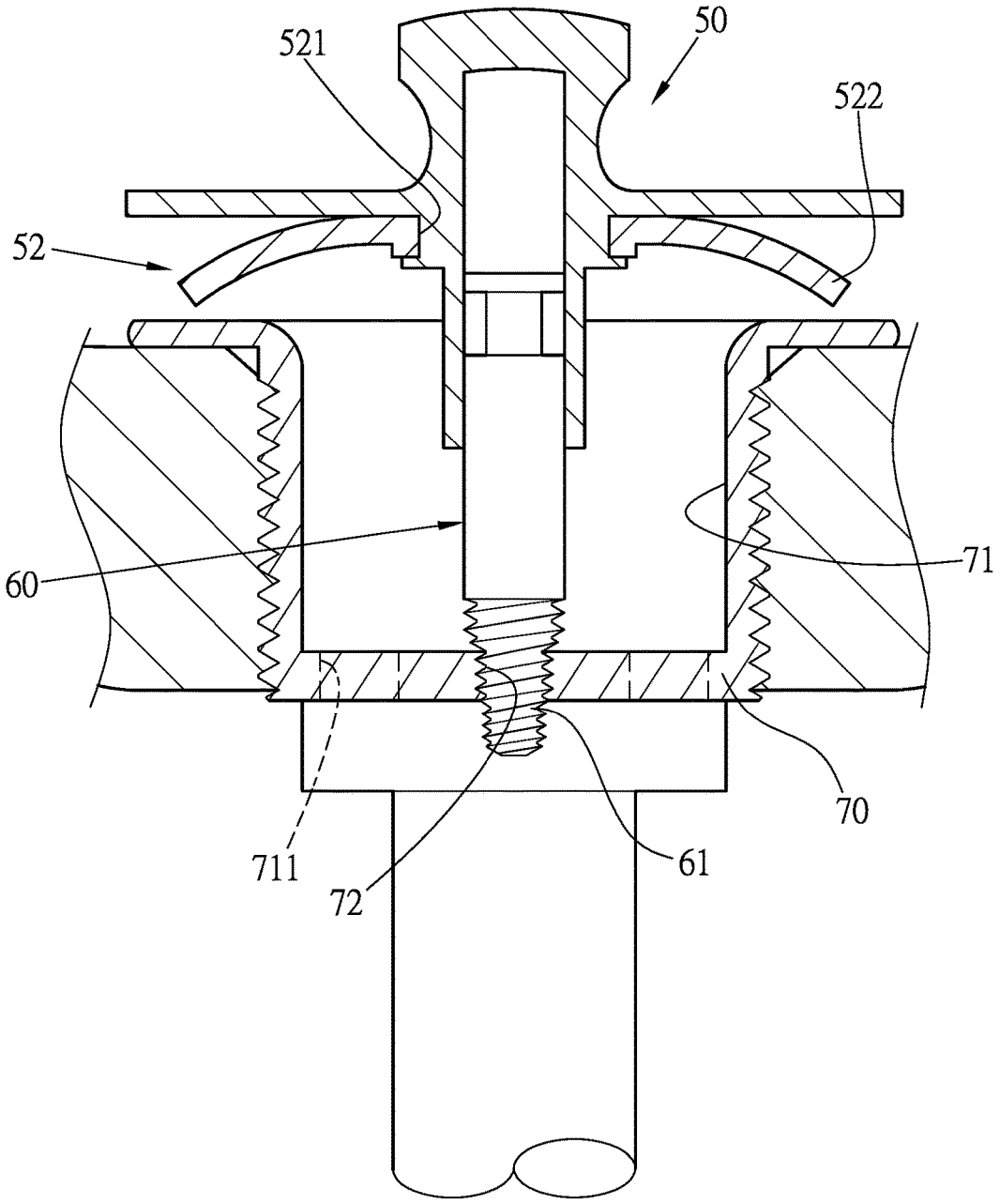
Fig. 4 PRIOR ART
FIG. 4 is a cross sectional view to show the conventional stopper.

As shown in FIGS. 2 and 3, the seal part 40 connected to the connection portion 35 and includes a support ring 41 and a collar 45. The support ring 41 has multiple hook members 411 formed in the inner periphery thereof. The hook members 411 are connected to the connection portion 35 of the cap 30. Alternatively, the hook members 411 may be in a single annular hook formed on the inner periphery of the support ring 41. A positioning portion 43 extends radially from the outer periphery of the support ring 41. A U-shaped recessed area 42 is formed between the positioning portion 43 and each of the hook members 411.

The collar 45 is a flexible rubber collar, and the thickness of the collar 45 is slightly larger than that of the support ring 41. A groove 451 is defined in the inner periphery of the collar 45, so that the positioning portion 43 of the support ring 41 is engaged with the groove 451 of the collar 45. It is noted that a distance is formed between the underside of the positioning portion 43 and the underside of the support ring 41. A distance is formed between the top of the positioning portion 43 and the underside of the flange 31. The positioning portion 43 of each of the hook members 411 has a protrusion 431 extending from the top thereof. The positioning portion 43 and the protrusion 431 are both engaged with the groove 451, wherein the protrusion 431 contacts the inside of the groove 451 to further secure the engagement between the positioning portion 43 and the groove 451. The support ring 41 supports the collar 45 so that the collar 45 is not separated from the support ring 41.

The seal part 40 is pushed upward from the underside of the cap 30, and each of the hook members 411 includes a hooking end extending at an angle from the distal end thereof. The hooking ends each have an inclined face so that the lip 351 is guided by the inclined faces until the hook members 411 move beyond the lip 351 and hook the top of the lip 351. Therefore, the top of the collar 45 contacts the underside of the flange 31. The underside of the collar 45 protrudes beyond the support ring 41.

When in use, the user pushes the cap 30 downward, the seal part 40 together with the cap 30 move downward along the shank 20 to let the collar 45 contact the top of the base part 10 to seal the room 11. Water can be stored in the sink or the tub. When pulling the cap 30 and the seal part 40 upward, the collar 45 is removed from the top of the base part 10, the water in the sink or the tub drains through the drain holes 12. It is noted that the bolt 322 simply slightly contacts the flat surface of the shank 32 so as to prevent the cap 30 from rotating relative to the shank 32. In other words, the cap 30 can only be moved up and down relative to the shank 32, and does not restricted by the bolt 322.

The support ring 41 supports the collar 45 so that the collar does not deform due to gravity when the collar 45 is removed from the top of the base part 10. Therefore, the collar 45 does not affected by air or water, no noise will be generated.

While we have shown and described the embodiment in accordance with the present invention, it should be clear to those skilled in the art that further embodiments may be made without departing from the scope of the present invention.

What is claimed is:

1. A stopper of a bathroom sink or tub, comprising:

a base part having a cylindrical room defined therein and adapted to be connected to a sink or a tub, the base part having an open top and at least one drain hole defined through a bottom thereof;

a shank removably connected to the base part and partially located in the room;

a cap having a flange extending radially therefrom, a tubular portion extending from the underside of the cap, a top end of the shank connected to the tubular portion, a connection portion formed on an underside of the flange, and a seal part connected to the connection portion and having a support ring and a collar, the support ring having at least one hook member formed in an inner periphery thereof, the at least one hook member connected to the connection portion of the cap, a positioning portion extending radially from an outer periphery of the support ring, a distance formed between an underside of the positioning portion and the underside of the support ring, the collar being a flexible collar and a groove defined in an inner periphery of the collar, the positioning portion of the support ring engaged with the groove of the collar, the support ring supporting the collar.

2. The support device as claimed in claim 1, wherein the tubular portion of the cap has a recess defined in a lower end thereof, the top end of the shank is inserted into the recess, a bolt radially extends through the tubular portion and contacts against the shank.

3. The support device as claimed in claim 1, wherein the connection portion of the cap has an L-shaped cross section, a vertical portion of the L-shaped cross section of the connection portion is a lip which extends radially outward from the connection portion, each of the at least one hook member includes a hooking end that extends at an angle from a distal end of the at least one hook member so as to hook the lip.

4. The support device as claimed in claim 1, wherein a U-shaped recessed area is formed between the positioning portion and the at least one hook member, a distance is formed between a top of the positioning portion and the underside of the flange, a top of the collar contacts the underside of the flange, an underside of the collar protrudes beyond the support ring.

5. The support device as claimed in claim 1, wherein the positioning portion of each of the at least one hook member has a protrusion, the positioning portion and the protrusion are both engaged with the groove, the protrusion contacts an inside of the groove to secure an engagement between the positioning portion and the groove so that the support ring is not separated from the collar.

6. The support device as claimed in claim 1, wherein the wherein the connection portion of the cap has an L-shaped cross section, a vertical portion of the L-shaped cross section of the connection portion is a lip which extends radially outward from the connection portion, the support ring has one hook member formed in the inner periphery thereof, the hook member hooks the lip.

* * * * *